US009409310B2

(12) United States Patent
O'Halloran

(10) Patent No.: US 9,409,310 B2
(45) Date of Patent: Aug. 9, 2016

(54) COMBINED FEED ROLLER AND CONVEYOR SPROCKET/PULLEY FOR A TREE CHIPPER

(75) Inventor: James L. O'Halloran, Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 1070 days.

(21) Appl. No.: 13/206,326

(22) Filed: Aug. 9, 2011

(65) Prior Publication Data

US 2013/0037171 A1 Feb. 14, 2013

(51) Int. Cl.
*B27L 11/00* (2006.01)
*B02C 18/22* (2006.01)

(52) U.S. Cl.
CPC ..... *B27L 11/002* (2013.01); *B02C 18/225* (2013.01)

(58) Field of Classification Search
CPC ..... B02C 18/225; B02C 18/22; B27L 11/00; B27L 11/02; B27L 11/002
USPC ..... 144/370, 246.1, 245.2, 250.24, 246.2, 144/248.2, 248.3, 248.5, 248.6; 241/92, 241/37.5, 186.2, 186.3, 186.35, 28; 198/834, 835
See application file for complete search history.

(56) References Cited

U.S. PATENT DOCUMENTS 3,275,049 A 9/1966 Gunn
3,425,361 A * 2/1969 Bishop ..... 104/172.2
3,536,265 A 10/1970 Cervenak
3,537,570 A * 11/1970 Sillars ..... 198/470.1
3,844,489 A 10/1974 Strong
3,990,937 A * 11/1976 Knowles ..... 156/558
4,057,192 A 11/1977 Smith
4,308,019 A * 12/1981 Horkey ..... F16H 55/30 198/834
RE31,048 E 10/1982 Smith
4,665,786 A 5/1987 Shields
5,988,539 A * 11/1999 Morey ..... 241/34
7,258,293 B2 * 8/2007 Tanaka et al. ..... 241/186.35
7,546,964 B2 6/2009 Bouwers
7,753,193 B2 * 7/2010 Kanaris ..... 198/834

OTHER PUBLICATIONS

Copy—6 pages. First 3 pages from a website showing the Bandit Model 2590; the last 3 pages are photo images of a Bandit Model 2590.
Copy—2 pages of International Search Report for PCT/US2012/050131 which is a counterpart application.

* cited by examiner

*Primary Examiner* — Matthew G Katcoff
(74) *Attorney, Agent, or Firm* — Sturm & Fix LLP

(57) ABSTRACT

A log/tree chipper having an infeed with a roller member, such as a sprocket or pulley, guides a chain has at least one lug in the roller member, such lug extending above the outer surface of the chain and above a feed table. One or more auxiliary feed members with lugs can rotate with and along the same axis of rotation of the roller member and be spaced to one side of a roller member. The auxiliary feed member can be positioned at the material exit end of a feed table, or at both ends of a feed table. Lugs on the auxiliary feed members and/or the roller members/sprockets are, in some embodiments, positioned at the material exit end of the feed table work so as to work in a symbiotic relationship with the main feed roller.

17 Claims, 16 Drawing Sheets

COMBINED FEED ROLLER AND CONVEYOR SPROCKET/PULLEY FOR A TREE CHIPPER

CROSS REFERENCE TO RELATED APPLICATIONS

U.S. patent application Ser. No. 13/206,245, filed Aug. 9, 2011, entitled "INDIVIDUAL FEED CHAIN TENSION SYSTEM FOR TREE CHIPPER", now abandoned, which is incorporated herein by reference in its entirety.

BACKGROUND OF THE INVENTION

1. Field of the Invention

This invention relates to feed control for a log and/or tree chipper. More particularly, the invention relates to an apparatus for improving the feeding performance of the infeed system of a log and/or tree chipper without increasing the cost or complexity thereof by providing an additional feed roller under the main feed roller on the feed table of a log/tree chipper.

2. Background Art

The present state of the art in large log/tree chippers is to help assist feeding with an infeed conveyor on the feed table. The infeed conveyor is typically a series of WD style drag chains running side by side. The individual drag chains may have a small, occasional tooth welded to the side of the chain every four to eight links to assist in the movement of material. The chain runs around a head pulley and a tail pulley assembly. The head pulley is made up of a shaft with a wide sprocket welded to the shaft at every drag chain. The sprocket drives the infeed chain and the infeed chain moves the material to be fed. The lack of aggressive features means that the chain will move material laying on it as long as it does not meet restriction from other infeed features. If the material is restricted, then the chain and head pulley slip underneath the material and the upper feed roller is thereby forced to do all of the work. To solve this problem one manufacturer of this type of machine has begun to install a lower feed roller between the head pulley and the cutter drum shear bar. This lower feed roller has aggressive knives welded to the outside surface to bite into the wood like the top, main, feed roller. With this aforementioned arrangement, the wood is pinched between an upper and lower aggressive feed roller and is more likely to overcome restrictions as the wood is forced towards the cutter drum. A disadvantage is that this adds expense, complexity, and increased possibilities for failure. The additional expense is in the production of the added feed roller and the drive system for it. The additional complexity results from there being more parts required, especially in combining the drives effectively of the main feed roller and the added lower one. The increased failure points result from the use of the needed additional bearings, the drive system, also resulting in more locations for material to wrap around one of the additional shafts.

There is, therefore, a need for a method and apparatus for overcoming the aforementioned problems with prior art feed roller systems for large tree/log chippers.

BRIEF SUMMARY OF THE INVENTION

In the present invention, fewer moving parts are used to solve the aforementioned feed roller problem by adding log engaging lugs on the pulley/sprocket closest to the feed roller instead of having both a pulley/sprocket nearest the feed roller and an additional feed roller that rotate on a different axis near the top of the feed table adjacent to the main feed roller.

The log/tree chipper has an infeed with a roller member, such as a sprocket or pulley, guides a chain has at least one lug in the roller member, such lug extending above the outer surface of the chain and above a feed table. One or more auxiliary feed members with lugs can rotate with and along the same axis of rotation of the roller member and be spaced to one side of a roller member. The auxiliary feed member can be positioned at the material exit end of a feed table, or at both ends of a feed table. Lugs on the auxiliary feed members and/or the roller members/sprockets are, in some embodiments, positioned at the material exit end of the feed table work so as to work in a symbiotic relationship with the main feed roller.

In some embodiments of the present invention an additional feed roller is placed to one side of one of the feed chain(s) on the feed table, instead of under the main feed roller as in the prior art, and in other embodiments such additional feed roller(s) is(are) placed adjacent one or more feed chains or conveyors on the feed table, with or without the additional lugs on the pulley/sprocket closest to the main feed roller, the additional feed roller(s) rotating about the same axis, and preferably even on the same shaft, as the adjacent pulley/sprocket.

DETAILED DESCRIPTION OF THE INVENTION

Figure 1:
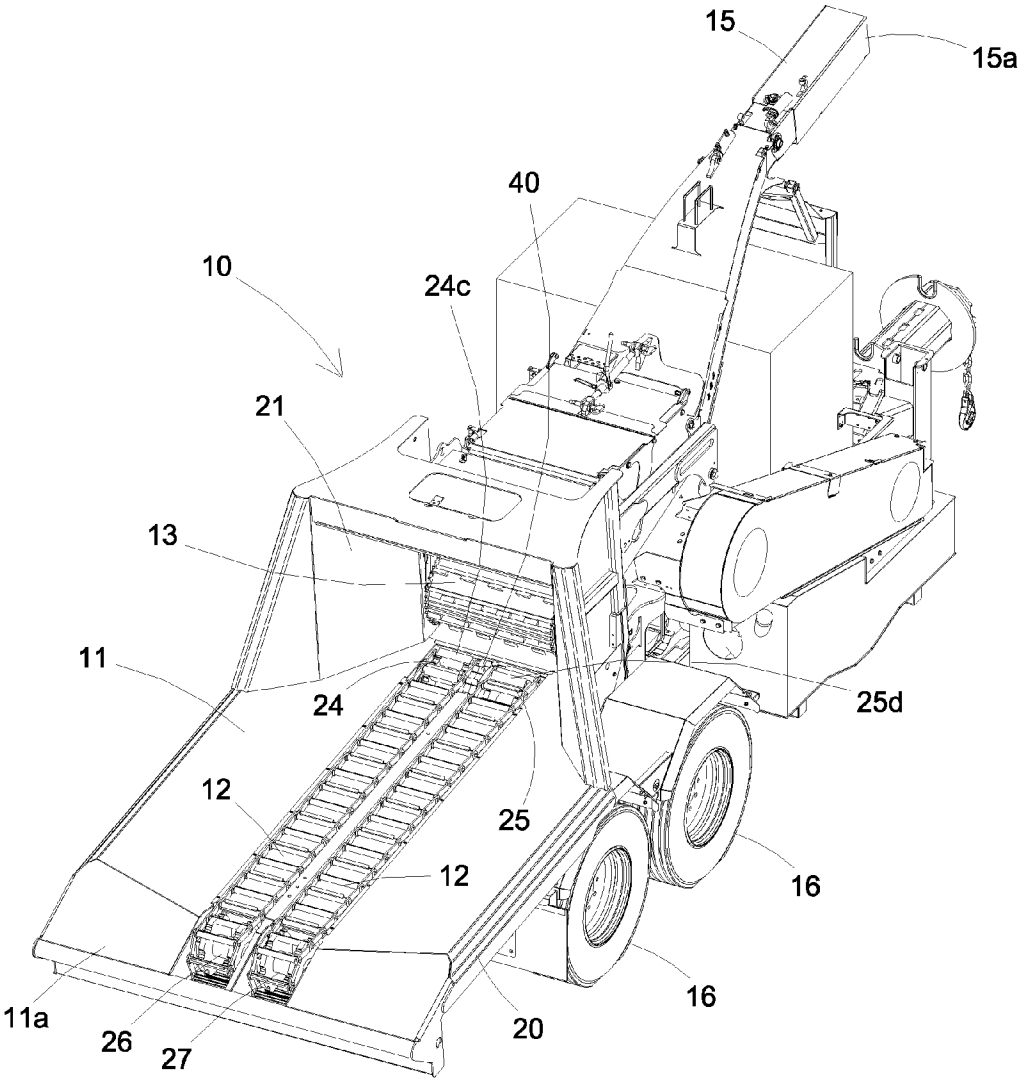
FIG. 1 is a perspective view of a whole tree chipper constructed in accordance to the present invention with a feed table having two drag chains for moving logs/trees to a feed roller, and showing log engaging structures on sprockets and an auxiliary feed roller extending above the feed table adjacent the main feed roller.

With reference now to the various figures in which identical elements are numbered identically throughout, a description of various exemplary aspects of the present invention will now be provided. The preferred embodiments are shown in the drawings and described with the understanding that the present disclosure is to be considered an exemplification of the invention and is not intended to limit the invention to the embodiments disclosed.

Figure 4:
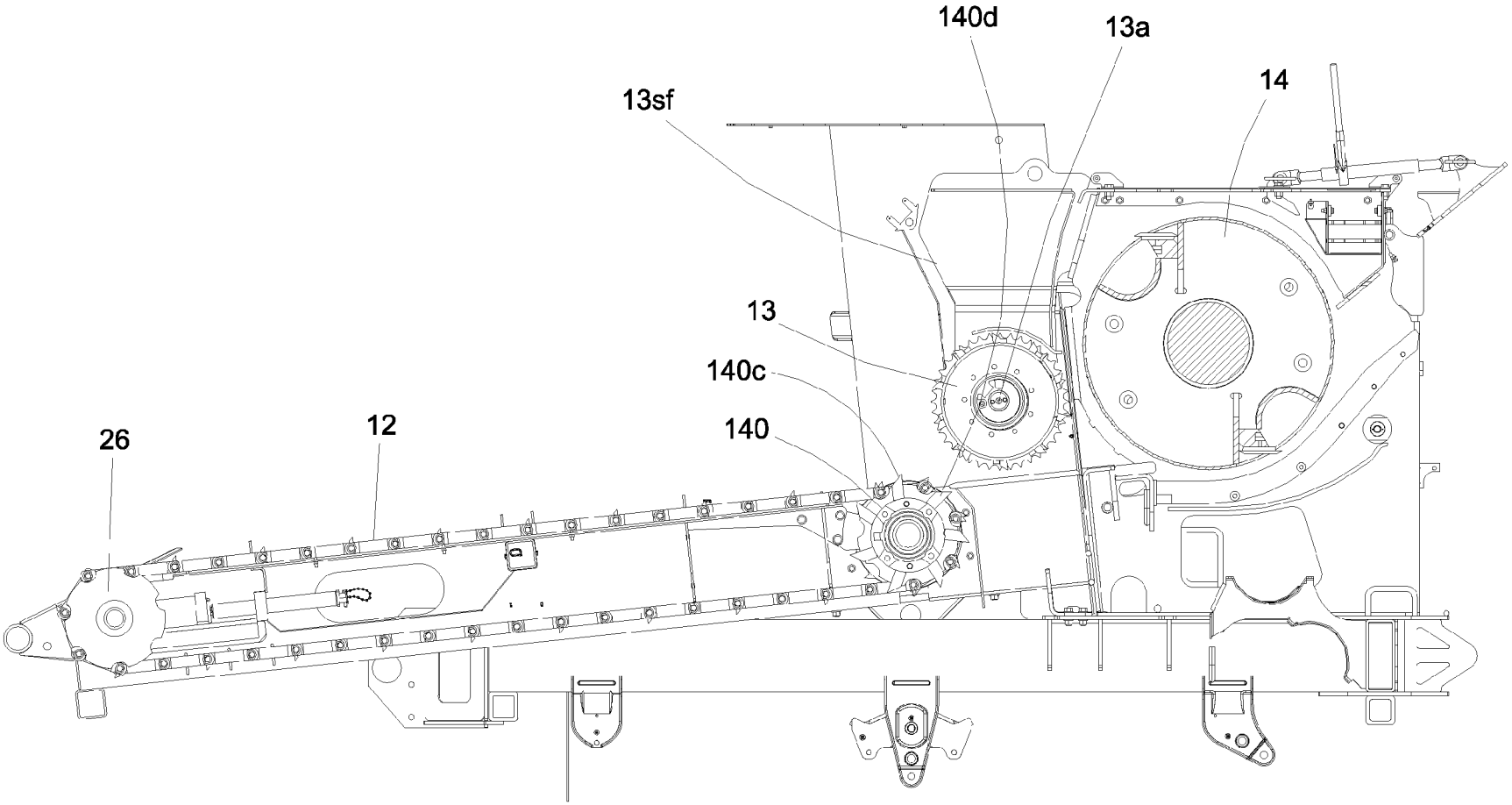
FIG. 4 is a side elevational view of the chipper from the side of FIG. 2 with a portion of the feed table removed to show a chipper drum, the main feed roller, an feed chain trained around a powered drive sprocket near the feed roller and an idler sprocket at a material entrance end of the feed table.

FIG. 1 shows log or whole tree chipper 10, with a feed table 11 having two feed chains 12 for moving trees or logs towards a feed roller 13. As in chippers in general, the feed roller 13 forces the logs or trees towards a chipping drum 14, as best shown in FIG. 4. The material reducing or chipping drum 14 cuts the wood into small chips and forces the small chips out a chute 15 as is typical of chippers of any size.

The brush chipper 10 is mounted on wheels 16 (FIG. 1), however, tracks and skids may also be used, and the brush chipper 10 may be stationary as well. The present invention is not limited to any particular conveyance apparatus, nor does it require the brush chipper 10 be portable.

Generally, the brush chipper 10 has a rear, feed end 11*a* and a front, outfeed end, 15*a*. A feed direction is defined, for the purposes of this document, including the claims, as the direction the brush is forced while it is being chipped; that is, the feed direction is the direction going from the feed end, or material entrance end at 11*a*, to the out feed, or material exit end, of the chipper 10, towards outfeed end 15*a* when the chute 15 is in the position shown in FIG. 1.

Figure 3:
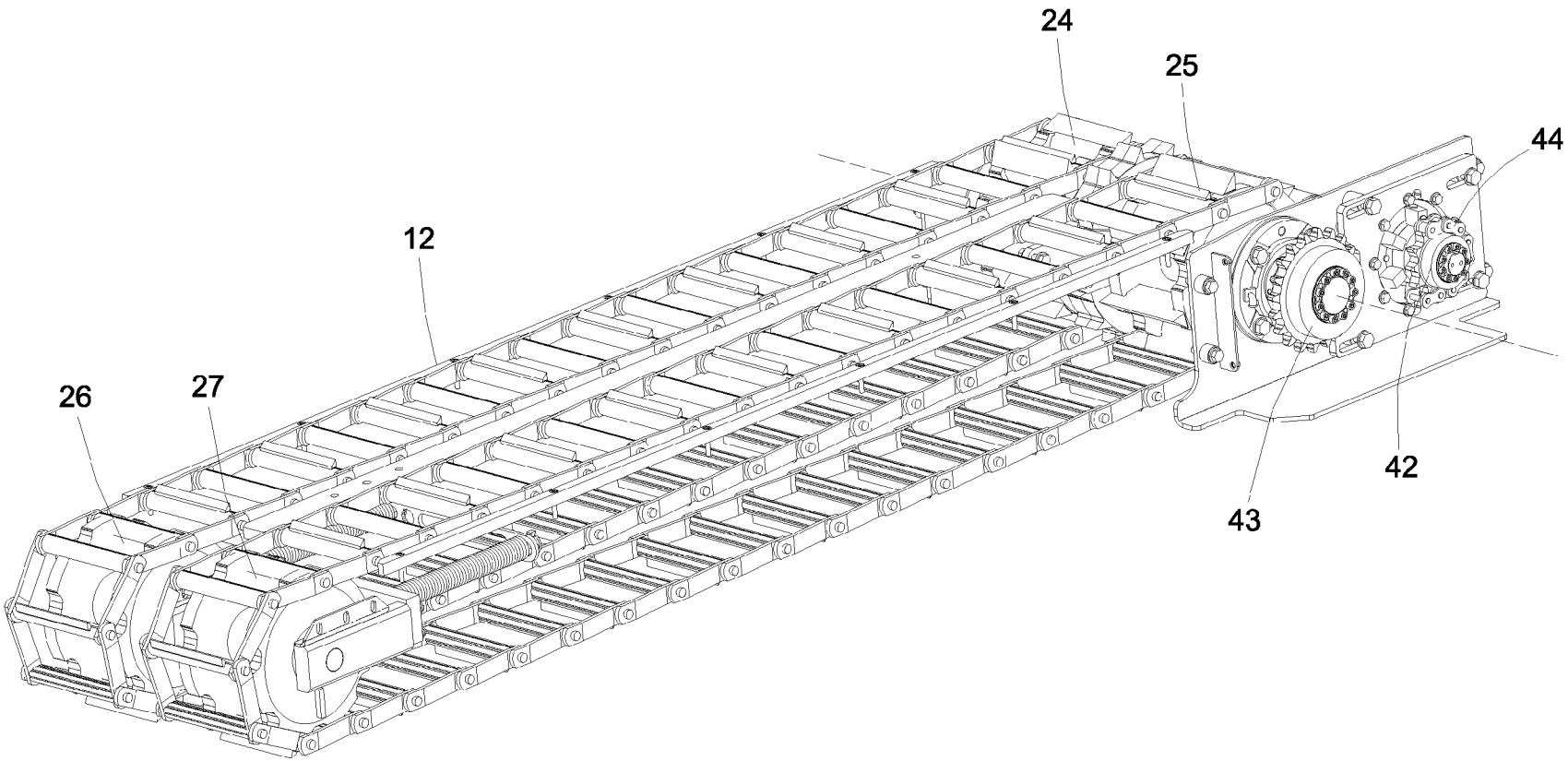
FIG. 3 is an enlarged perspective view of the two chains and the drive system therefore of FIG. 1 with the feed table removed to show an feed chain trained around a powered drive sprockets near the feed roller and a idler sprockets at a material entrance end of the feed table.

The brush chipper machine 10 for processing logs and whole trees has a frame 20. The material reducing drum 14, shown best in FIG. 3, is operatively rotatably attached to the frame 20. The feed table 11 is bolted to the frame 20 for receiving and supporting trees and logs thereon, the feed table 11 having a top, a bottom, a front end and a rear end.

Looking to FIG. 4, the feed roller 13 is disposed between the feed table 11 and the material reducing drum 14 and is rotatably attached to a sub-frame 13*sf* about rotational axis 13*a*. The sub-frame 13*sf* is pivotally attached about pivotal axis 13*pa* so that the feed roller 13 can move up or down as logs/trees move there under towards the material reducing drum 14.

FIG. 1 shows a pair of mostly vertical walls 21 on each side of the feed roller 13, the walls 21 having a front and a rear and being farther apart at the rear thereof than at the front thereof for funneling logs and trees from the feed table 11 to the feed roller 13 and eventually to the material reducing drum 14.

Figure 2:
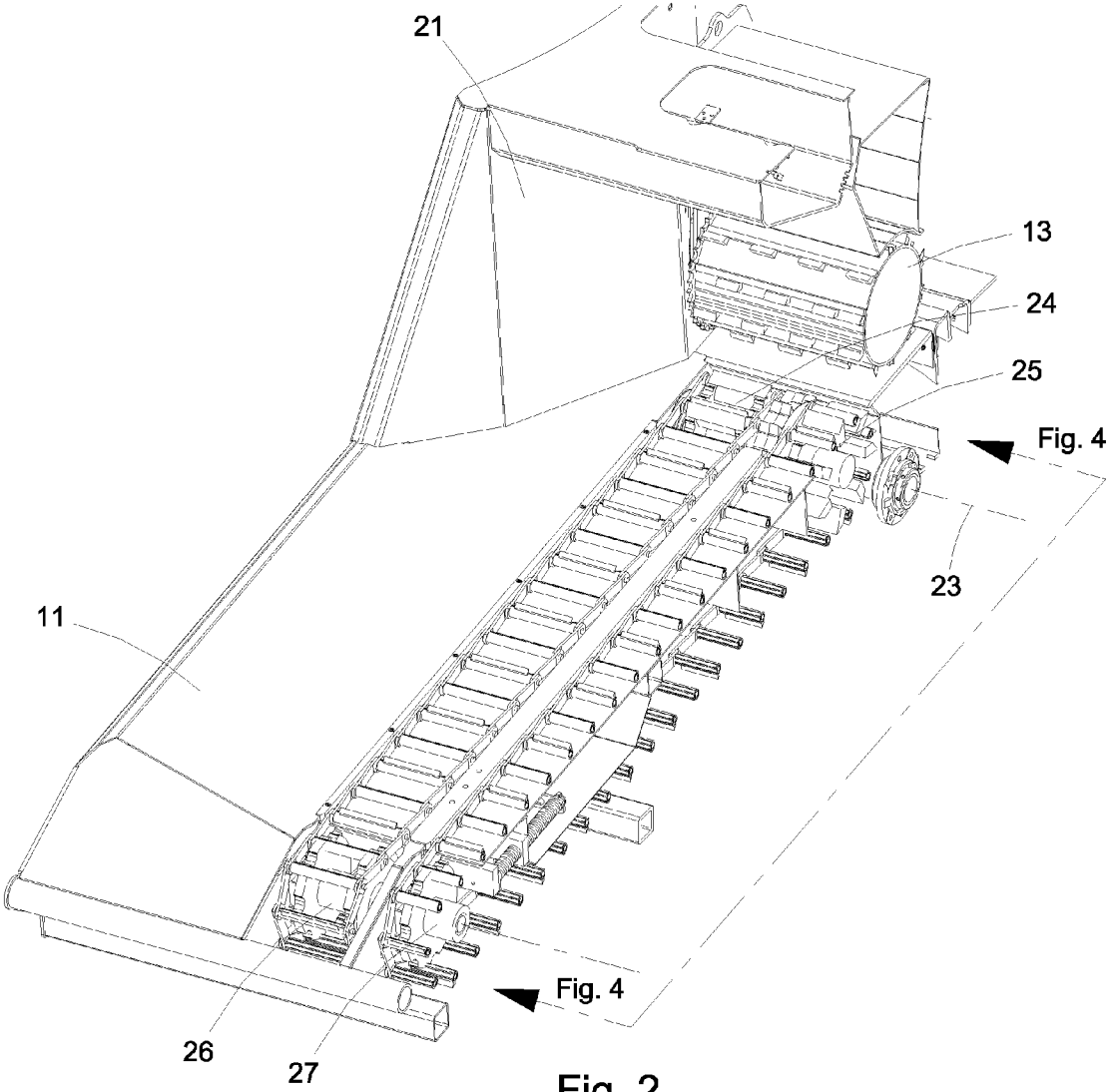
FIG. 2 is a perspective view of the chipper of FIG. 1 with a portion of the feed table removed to show an feed chain trained around a powered drive sprocket near the feed roller and an idler sprocket at a material entrance end of the feed table.

Looking to FIGS. 1 and 2, a first powered drive member, sprocket 24, (which could also be a pulley) is operatively rotatably attached to the frame along a first substantially a horizontal axis 23 located below the top, front end of the feed table 11. A second powered drive member, sprocket 25, (which could also be a pulley) is operatively rotatably attached to the frame along a second substantially horizontal axis located below the top, front end of the feed table 11, which second substantially horizontal axis can be coincident with the first substantially horizontal axis 23.

Looking now to FIGS. 1-6, a first idler member, sprocket 26 (which could also be a pulley type idler) is operatively rotatably attached to the frame along a third substantially horizontal axis 28 (FIG. 6) located below the top, rear end of the feed table 11. A second idler member 27 (sprocket or pulley) operatively rotatably attached to the the frame along a fourth substantially horizontal axis 29 (FIG. 6) located below the top, rear end of the feed table 11.

Looking now to FIGS. 1-4, there is a first feed conveyor chain 12, less than half the width of the feed roller 13, the first feed conveyor chain 12 being trained around the first powered drive member 24 and the first idler member 26 for selectively moving the logs and trees along the feed table 11 to the feed roller 13. A second feed conveyor chain 12 is also less than half the width of the feed roller 13, the second feed conveyor chain 12 being trained around the second powered drive member 25 and the second idler member 27 for selectively moving the logs and trees along the feed table 11 to the distance between the first substantially horizontal axis 23 and the third substantially horizontal axis 28 can be the same or can be a variable distance as disclosed in U.S. patent application Ser. No. 13/206,245, filed Aug. 9, 2011, now abandoned, which is incorporated herein by reference in its entirety.

Figure 5:
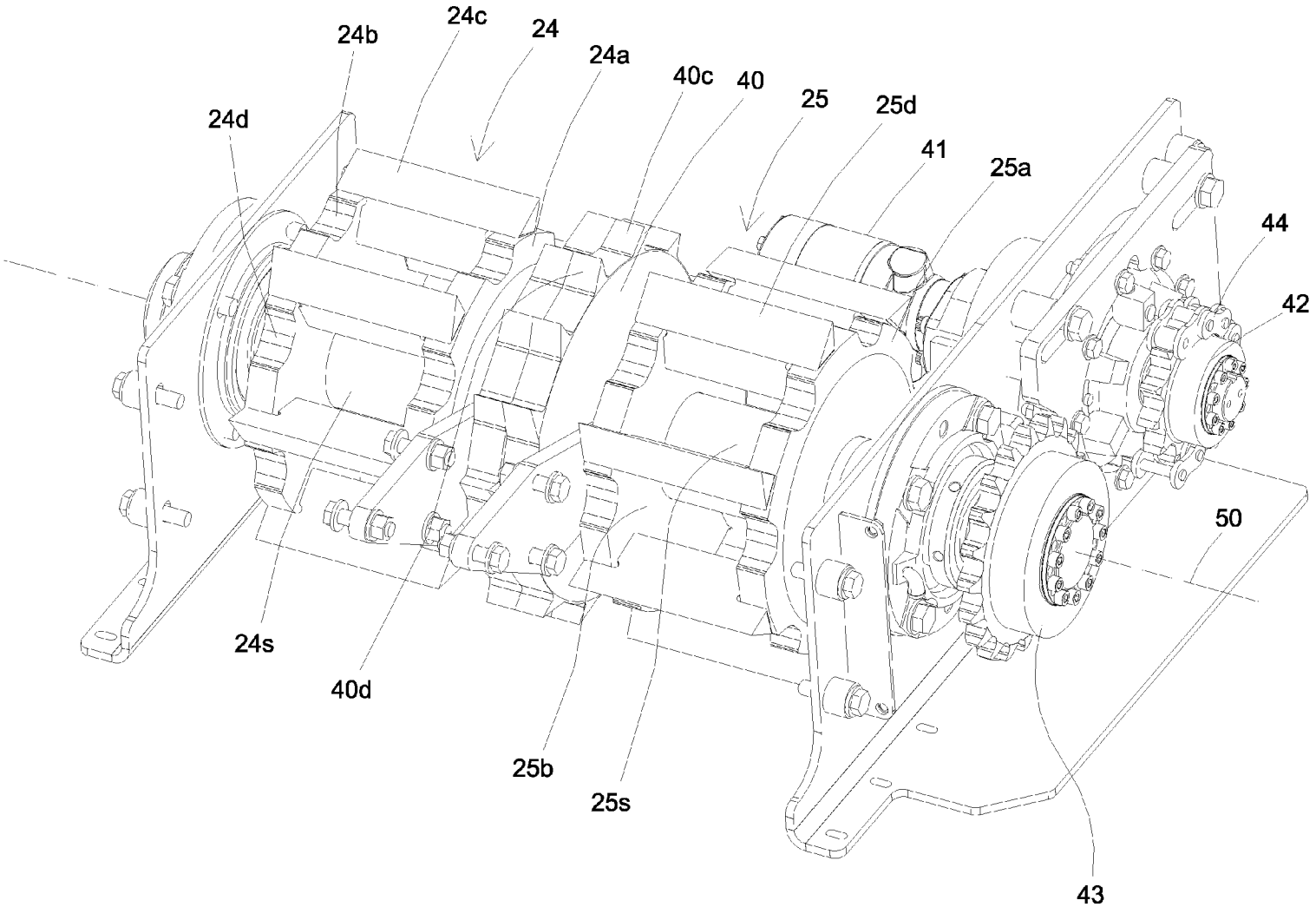
FIG. 5 is an enlarged perspective view of the sprockets closest to the main feed roller as shown in FIG. 3, and also showing portions of the drive system that powers these sprockets.

Looking at FIG. 5, a sprocket 24 has a rotating shaft 24*s* with discs 24*a* and 24*b* rigidly attached thereto so that when driven by hydraulic motor 41, sprocket 42 will turn, causing chain 44 to transmit that rotation to sprocket 43, which will rotate both sprockets 24 and 25. Sprocket 25 is constructed like sprocket 24, with a center shaft portion 25*s*, spaced apart discs 25*a* and 25*b*. Also rigidly turning with the sprockets 24 and 25 is an auxiliary feed member 40, shown in FIG. 5 as being made with two discs having lugs 40*c* and 40*d* alternatively around the exterior periphery thereof. Sprockets 24 and 25 and auxiliary feed member 40 are all rigidly attached to each other. The lugs 40*c* are in rotational phase with lugs 24*c* on the sprocket 24 so that the lugs 40*c* and lugs 24*c* work together as the assembly 24, 25 and 40 rotate, to push a tree or log towards the main feed roller 13 and ultimately on towards the cutter drum 14 shown in FIG. 15, for example. Similarly, lugs 25*d* on sprocket 25 are aligned in phase with the rotation of lugs 40*d* on auxiliary feed member 40. Every other lug on auxiliary feed member 40 is a lug 40*c* aligned with a corresponding lug 24*c* on sprocket 24 and every other lug 40*d* on auxiliary feed member 40 is a lug 40*d* that aligns with lugs 25*d* on sprocket 25. All of the lugs 40*c* and 40*d* are identical on the embodiment shown. Similarly, all of the lugs 24*c* and 25*d* are identical in the embodiment shown in FIG. 5, for example. By alternating the pushing of the log or tree between lugs 24*c* on one side and then alternatively lugs 25*d* on the other side sequentially, less hydraulic pressure is required than if all of the lugs 24*c* and 25*d* were pushing together at the same time instead of being out of phase with respect to each other as they rotate.

Figure 6:
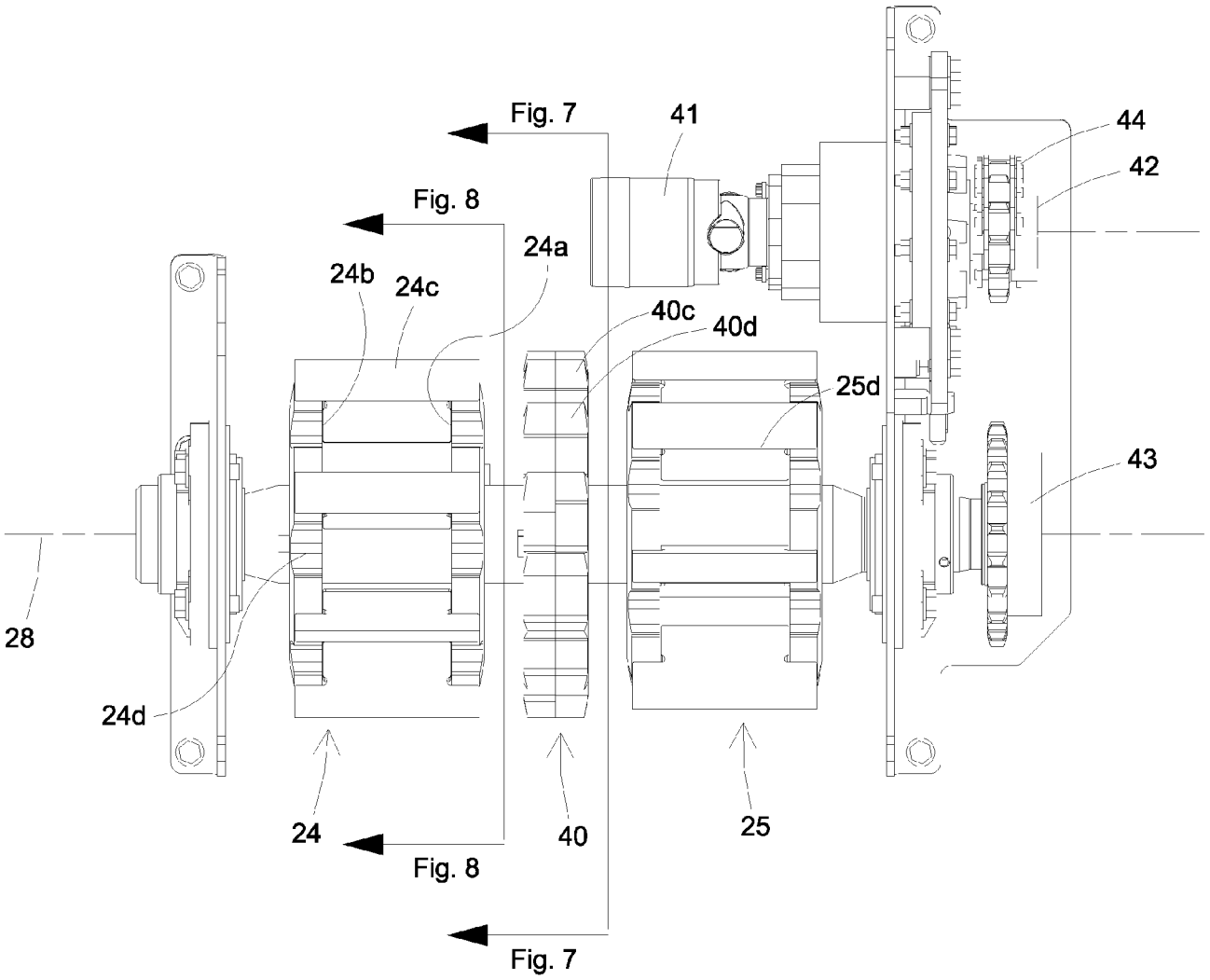
FIG. 6 is a partial top view of the structure shown in FIG. 5.
Figure 7:
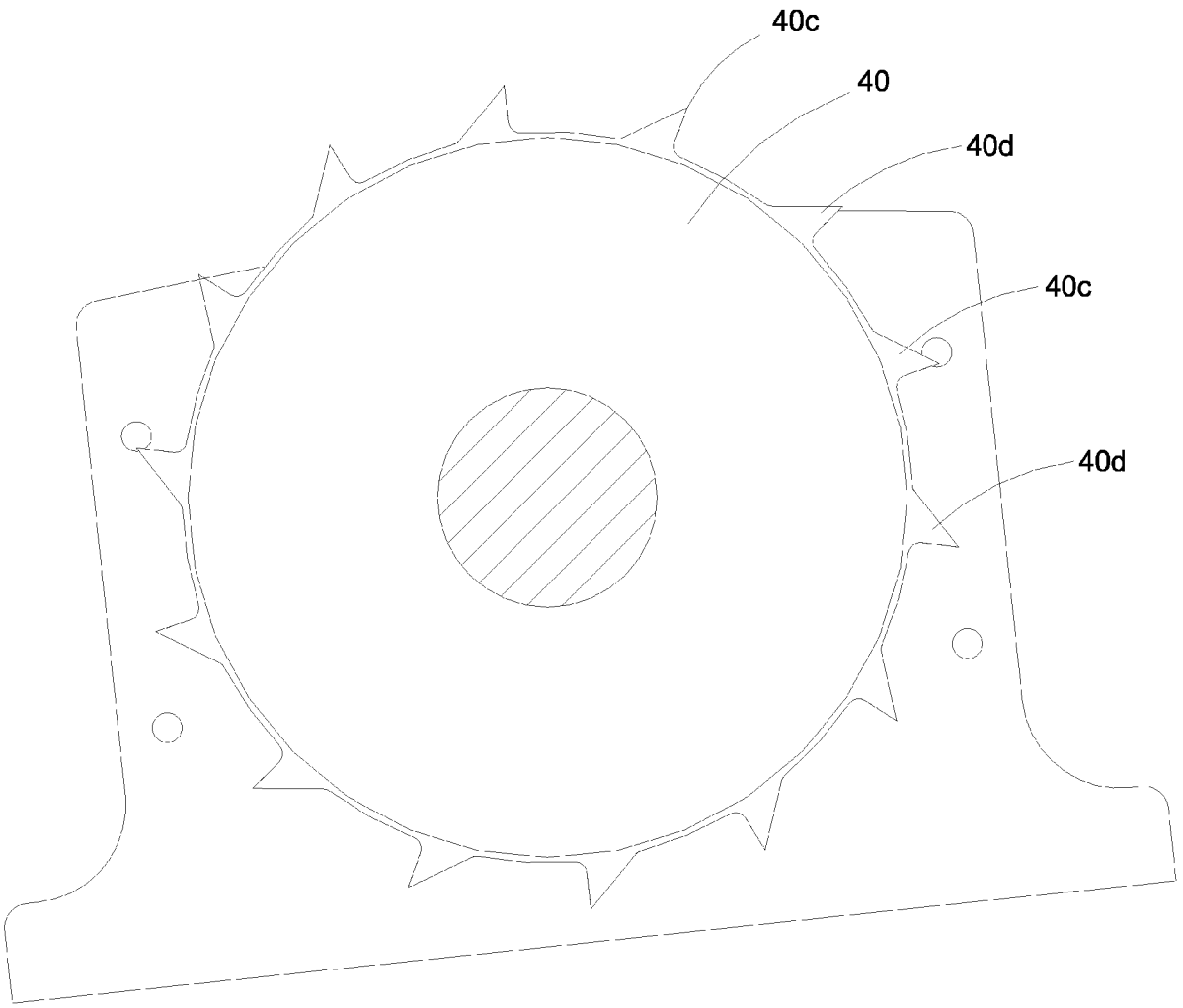
FIG. 7 is a cross sectional view taken along line 7-7 of FIG. 6.
Figure 8:
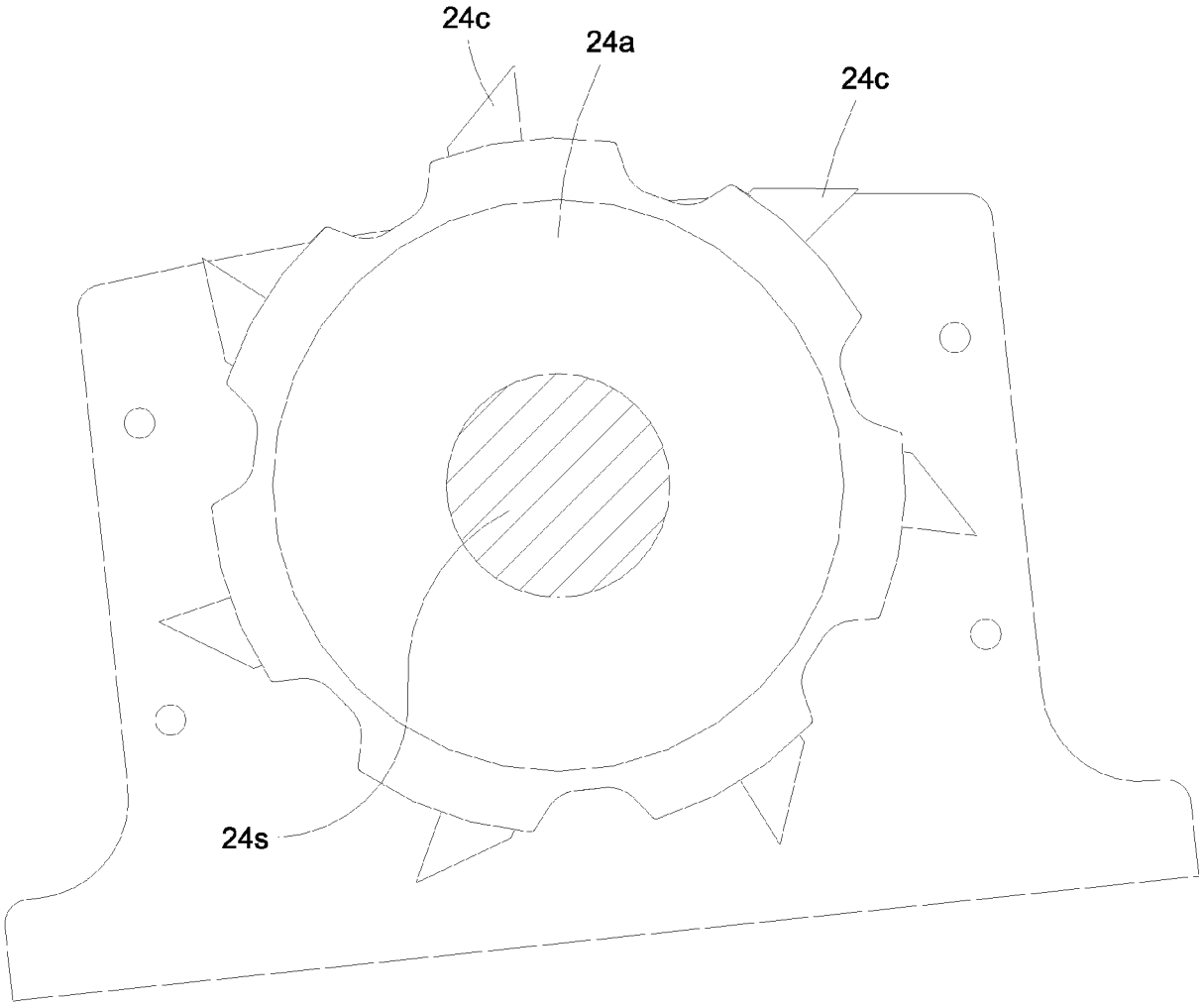
FIG. 8 is a cross sectional view taken along line 8-8 of FIG. 6.
Figure 9:
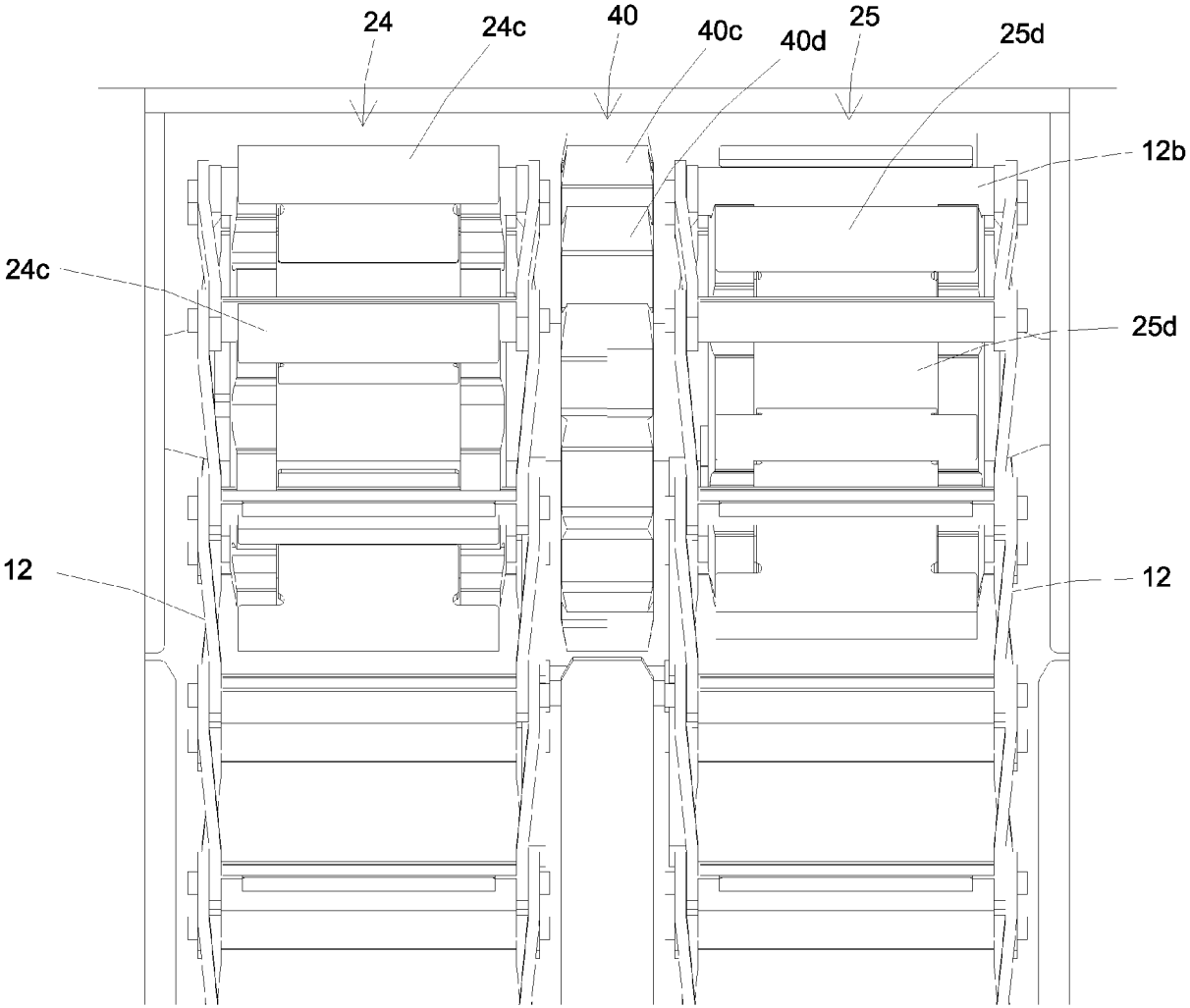
FIG. 9 is an enlarged top view like FIG. 6, but showing mainly only those portions of the sprockets, chains and auxiliary feed roller that are located closest to the main feed roller.
Figure 10:
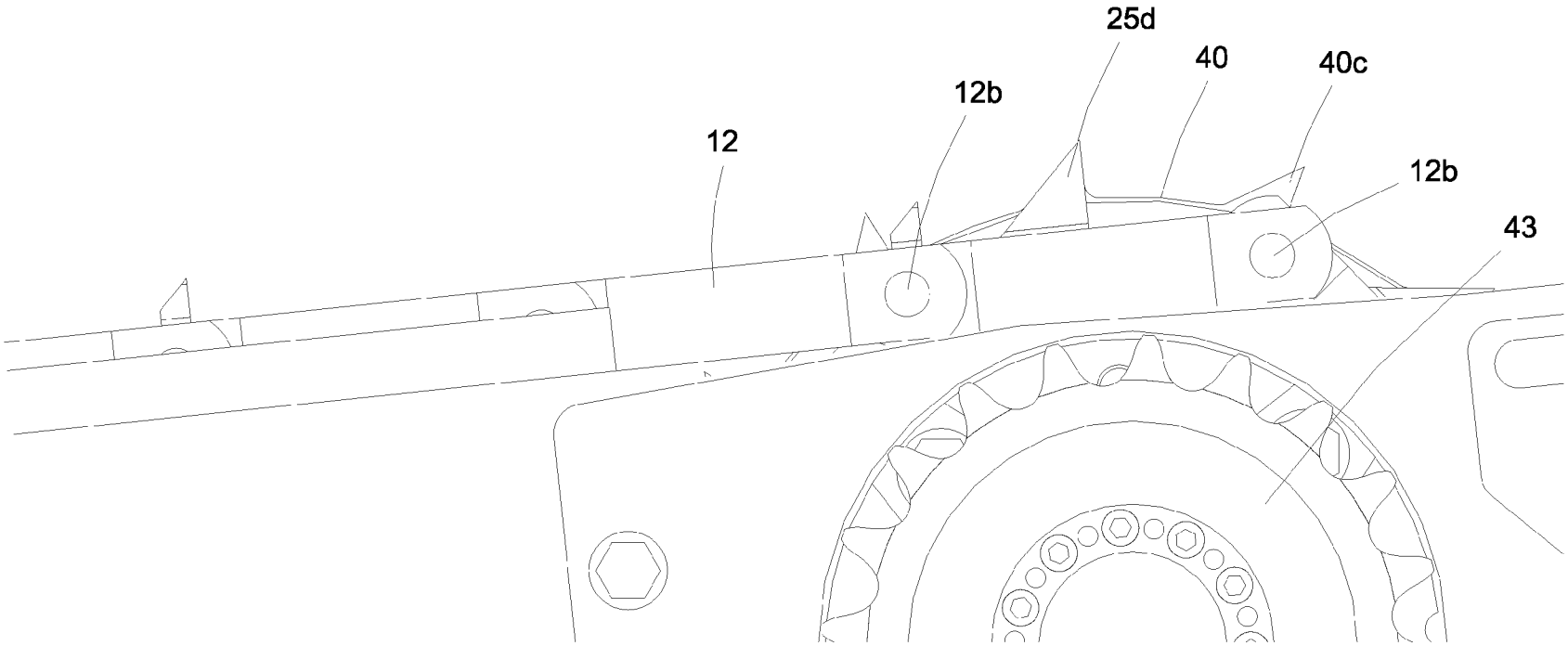
FIG. 10 is an enlarged, partial side view taken from the right side of FIG. 6, and showing the phase difference between the first and second log engaging structures on the sprockets shown and the lugs on the auxiliary feed roller.
Figure 11:
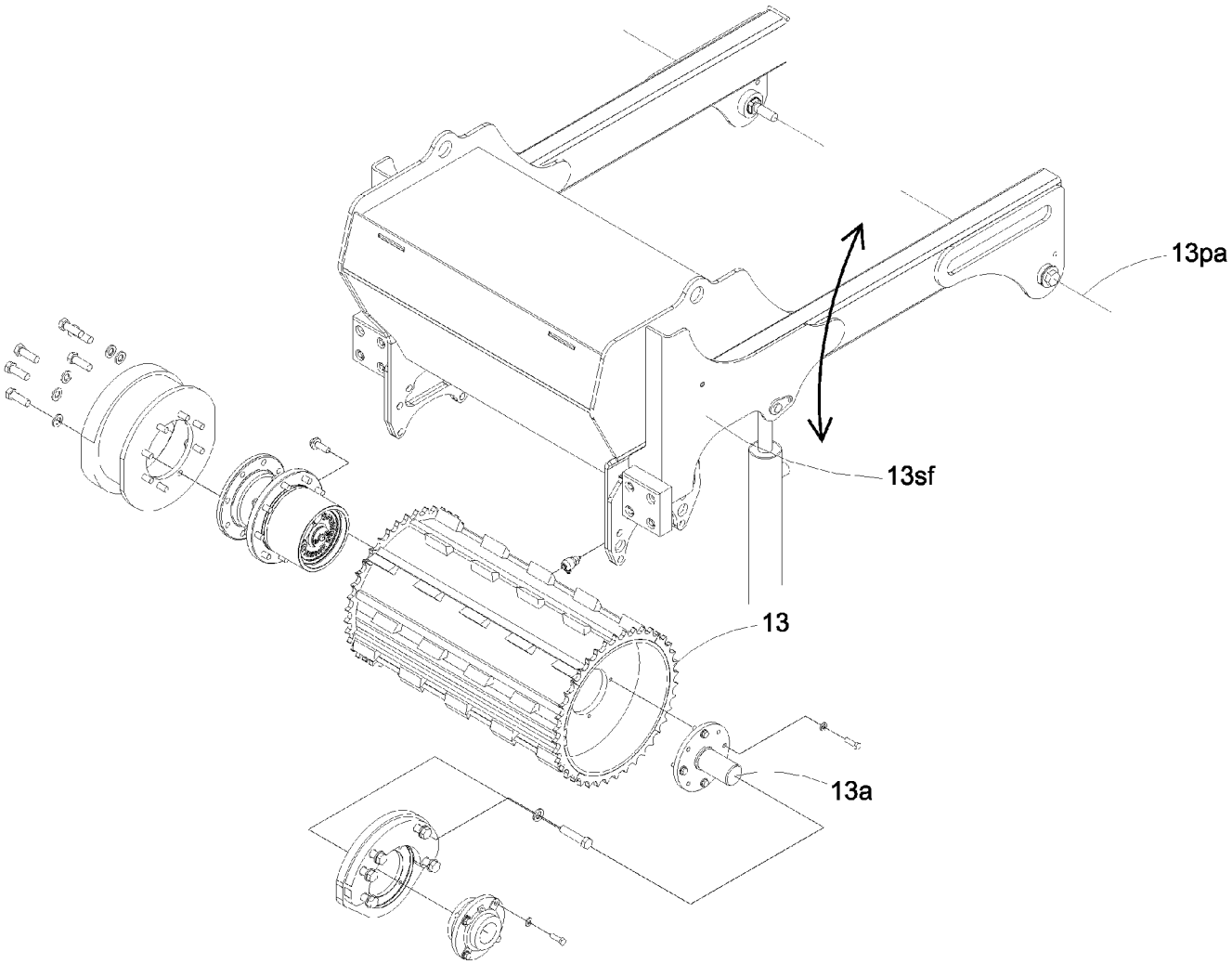
FIG. 11 is an exploded perspective view of the main feed roller and the system for mounting it to the frame of the machine, the arrow showing how the main feed roller can pivot up and down as material goes under it by pivoting a feed roller sub-frame which is pivotally attached to the main frame of the machine.

Looking at FIGS. 5 and 6, the lug structure 24*c*, 25*d*, 40*c* and 40*d* are all disposed for rotation about the first substantially horizontal axis 50, the lug structure 24*c*, 25*d*, 40*c* and 40*d* being operatively attached to and rotating with the first sprocket 24. This lug structure of lugs 24*c*, 25*d*, 40*c* and 40*d* is disposed above the feed table at times during rotation of the assembly of sprockets 24 and 25 and auxiliary feed member 40 so that the lugs contact material on the feed table and move the material towards the material exit end of the feed table, namely towards the main feed roller 13 and cutter drum 14. Locating these lugs 24*c*, 25*d*, 40*c* and 40*d* near the main feed roller 13 causes the lugs to work in close conjunction with the main feed roller 13 so they are much more effective than prior art auxiliary feed rollers such as feed rollers 22 as shown in FIG. 1 of U.S. Pat. No. Re31,048, for example. Lugs 24*c*, 25*d*, 40*c* and 40*d* push logs up and forward toward the main feed roller 13 while at the same time the main feed roller 13 is pushing down and pulling the log forward, towards the cutter drum 14, in close proximity to the forces applied by the lugs 24*c*, 25*d*, 40*c* and 40*d*.

The chain 12 on the left as shown in FIG. 1, has bars 12*b* (FIGS. 9 and 10) that extend across the sprocket 24 and ride in grooves 24*d* as shown in FIG. 5. Between each depression or groove 24*d* in the discs 24*a*, 24*b* the lugs 24*c* are welded at each end thereof to the discs 24*a* and 24*b*. These lugs 24*c* therefore stick up through openings in the chains 12 as shown in FIGS. 1, 2, 3, 9 and 10. The same thing is happening with the chain 12 and lugs 25*d* welded to discs 25*a* and 25*b*, since in the embodiment shown sprockets 24 and 25 are essentially identical except for being mounted to rotate together with the respective lugs 24*c* and 25*d* out of phase with each other.

In FIG. 4, the auxiliary feed member 140 is of a different configuration than the auxiliary feed member 40 shown in FIGS. 1-3 and 5-9, but the lugs 140*c* and 140*d* work just the same as lugs 40*c* and 40*d* on auxiliary feed member 40 and are in phase with lugs 24*c* and 25*d* respectively.

The relative widths of the discs 24*a* and 24*b* with respect to the much wider lugs 24*c* is significant, thereby allowing for much more area to catch and push a log than if lugs 24*c* were just radially outward extensions of the same width as discs 24*a* and 24*c*. So the structure of lugs 24*c*, extending up through openings in the open chain 12 provides significant advantages over the prior art. Since sprockets 24 and 25, except for being out of phase, are identical, the same advantages accrue to lugs 25*d* on sprocket 25 as lugs 24*c* do on sprocket 24.

Also, the relative narrow width of auxiliary feed rollers 40 and 140 as compared to the lugs 24*c* and 25*d* on sprockets 24 and 25 permits all of these lugs 24*c*, 25*d*, 40*c* and 40*d* to all fit in a relatively narrow space on the feed table adjacent the material exit end of the feed table adjacent the main feed roller 13, with the lugs 24*c* and 25*d* in a preferred embodiment being at least twice as wide as lugs 40*c* and 40*d*. While this is an optimum arrangement, there are significant advantages to having even one set of lugs 24*c*, 25*d*, 40*c* or 40*d* on the feed table 11 and not any of the other ones. Any combination of use of the lugs 24*c*, 25*d*, 40*c* or 40*d* sticking up through the feed table 11 would be helpful to keeping the material moving to the main feed roller 13 and to the cutter wheel 14.

Figure 12:
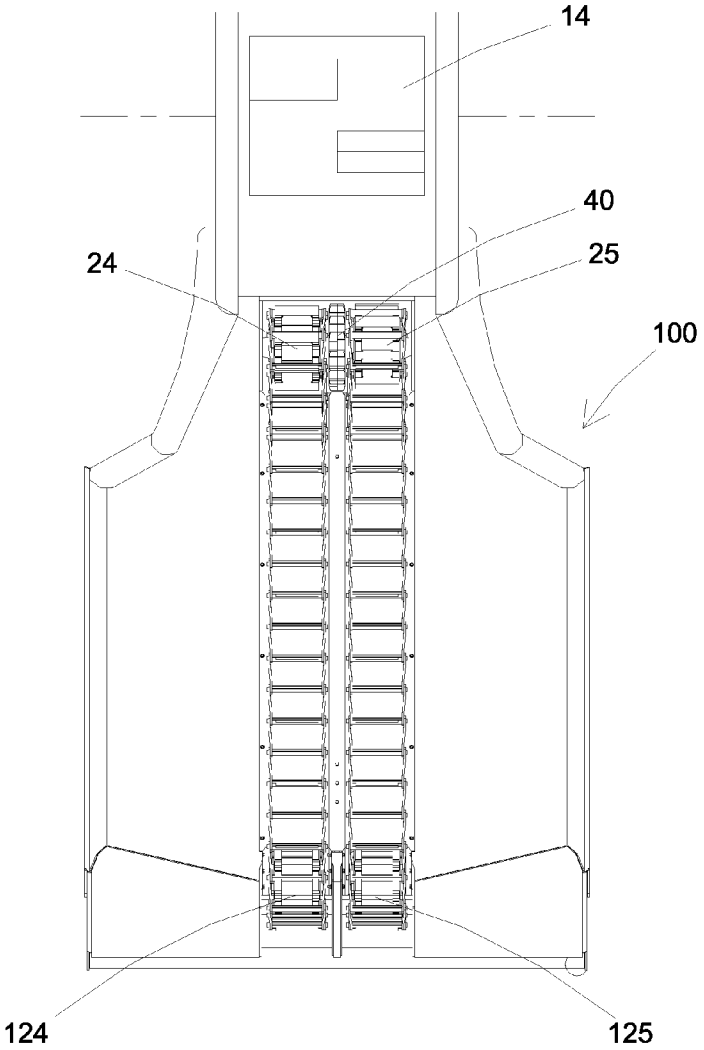
FIG. 12 is a top, somewhat schematic view, of the feed table, cutter drum, showing the two feed chains and the mounting sprockets that the chains are trained around.

FIG. 12 shows an alternate embodiment 100 where sprockets 124 and 125 at the material entrance end of the feed table 11 are identical to the sprockets 24 and 25 at the material exit end except that the sprockets 124 and 125 are idler sprockets instead of driven sprockets. So the lugs on these sprockets 124 and 125 will also push logs on the feed table toward the cutter drum 14.

Figure 13:
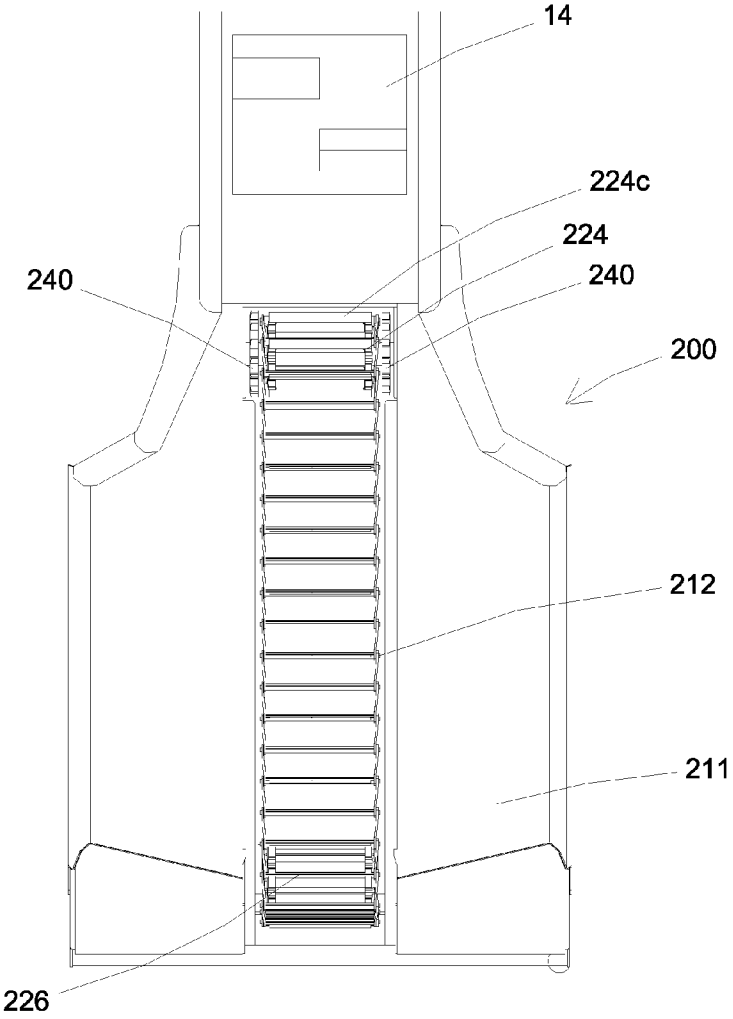
FIG. 13, an alternate embodiment, shows a top, somewhat schematic view, of a feed table, cutter drum, showing only one feed chain and the mounting sprockets that the chain is trained around, and also including auxiliary feed rollers on each side of the sprockets closest to the main feed roller.

FIG. 13 shows an alternate embodiment 200 with a front sprocket 224 that is like sprocket 24 of FIGS. 1-10, except that it is wider. Also, there are two auxiliary feed rollers 240 that are like auxiliary feed roller 40 of FIG. 5, but relatively narrower. So logs on the feed table 211 would be moved by the chain 212 towards the lugs 224*c* on roller 224 and those lugs 224*c*, in conjunction with the lugs on auxiliary feed rollers 240 will push the log towards the main feed roller 13 and towards the cutter drum 14.

Figure 14:
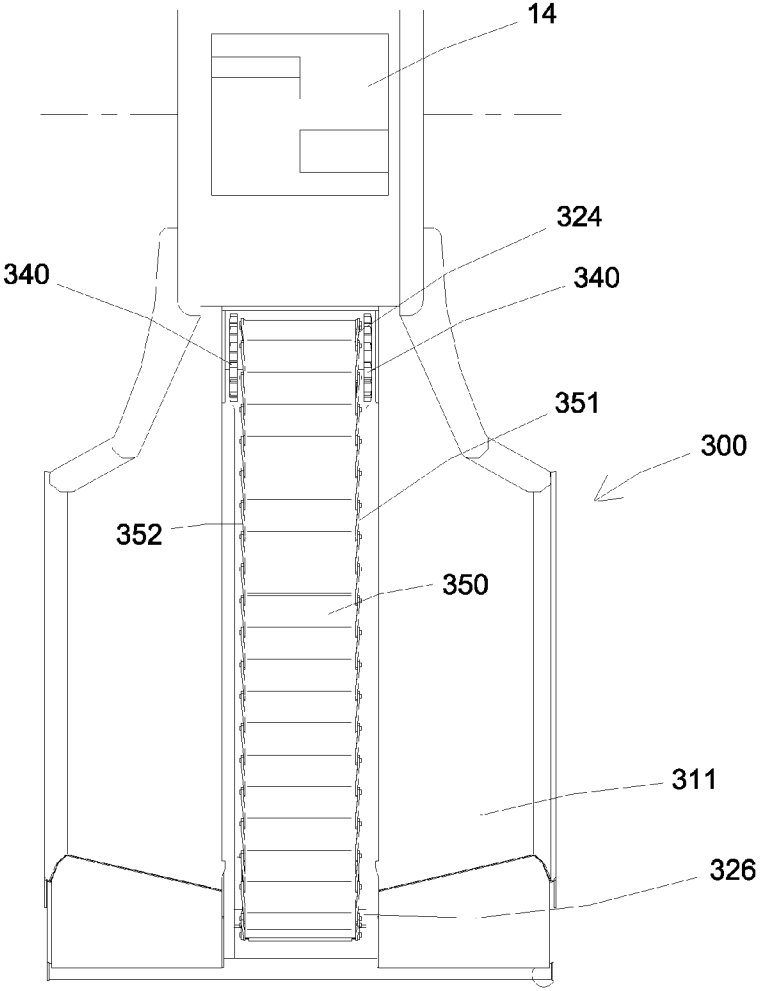
FIG. 14, also an alternate embodiment, is similar to FIG. 13 except that a conveyor belt comprising a plurality of metal plates replaces the conveyor chain which conveyor belt is trained around pulleys which do not have log engaging structures on them like the sockets of the FIG. 13 embodiment, relying on an auxiliary feed roller on each side of the pulley adjacent the main feed roller to help feed the material from the feed table past the main feed roller and the feed table towards the cutter drum, the auxiliary feed rollers being attached to the pulley and rotating around the same axis as that pulley closest to the main feed roller.

FIG. 14 is an alternate embodiment 300 showing an infeed table 311 having metal plates 350 between the two chains 351 and 352, to function like a solid conveyor, so that all that is seen in FIG. 14 are the joints between the metal plates, with chains 351 and 352 on each side of the plates 350. This type of conveyor would not be able to have lugs extending through these plates 350, but having the auxiliary feed rollers 340 provides significant advantages as explained above. Pulleys 324 and 326 are provided to keep the conveyor in place and permitting one of the pulleys 324 and 326 to be a driven pulley.

Figure 15:
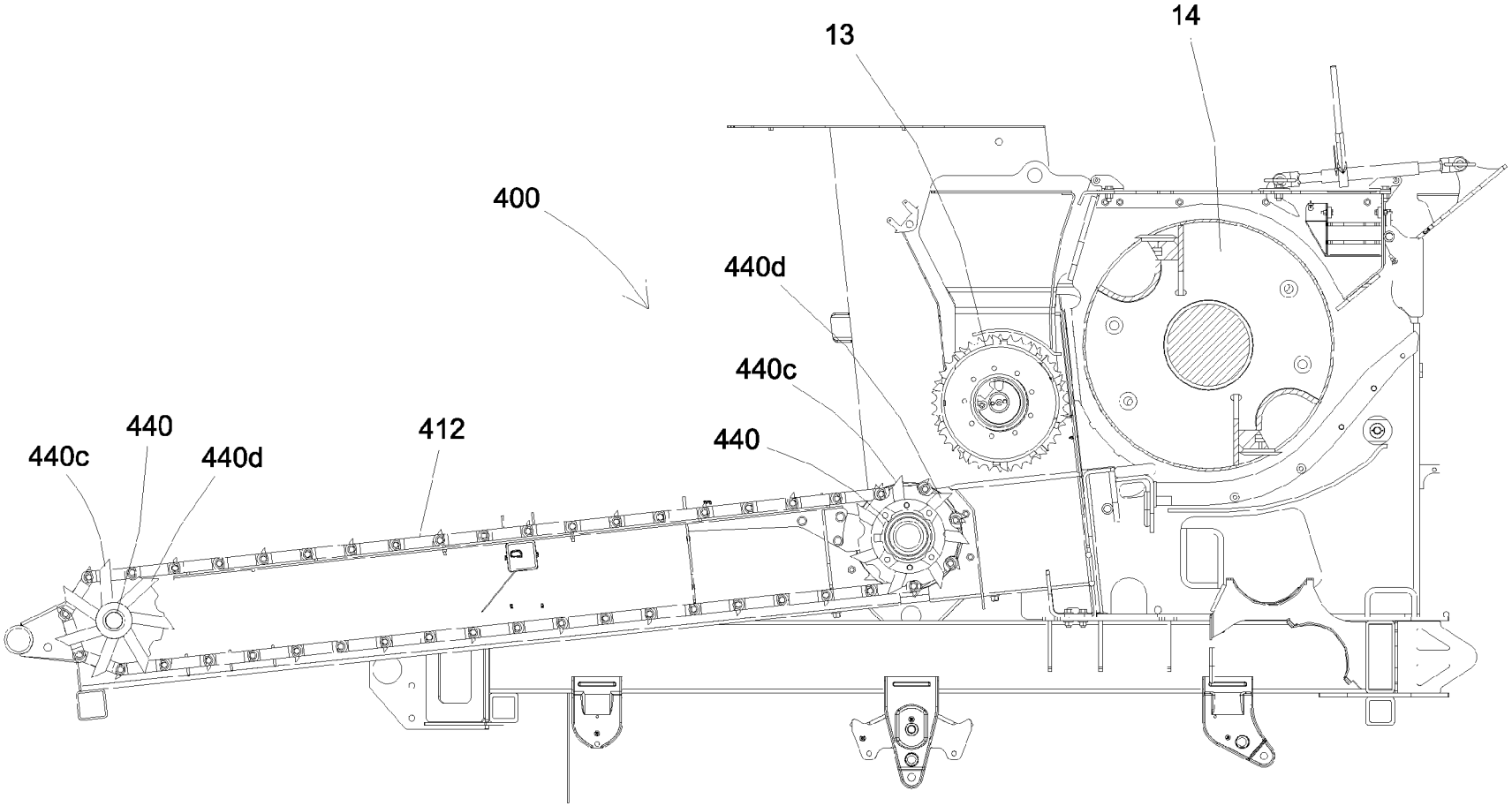
FIG. 15, another alternate embodiment, is a cross sectional view similar to FIG. 4, but using another auxiliary feed structure, in addition to the essentially duplicate auxiliary feed member closer to the main feed roller, the additional auxiliary feed rotary member is attached to the idler sprocket for rotation with the idler sprocket and having lugs thereon extending radially outwardly between the chain links and above the feed table for contacting trees or logs as they enter the feed table and moving them towards the chipper drum.
Figure 16:
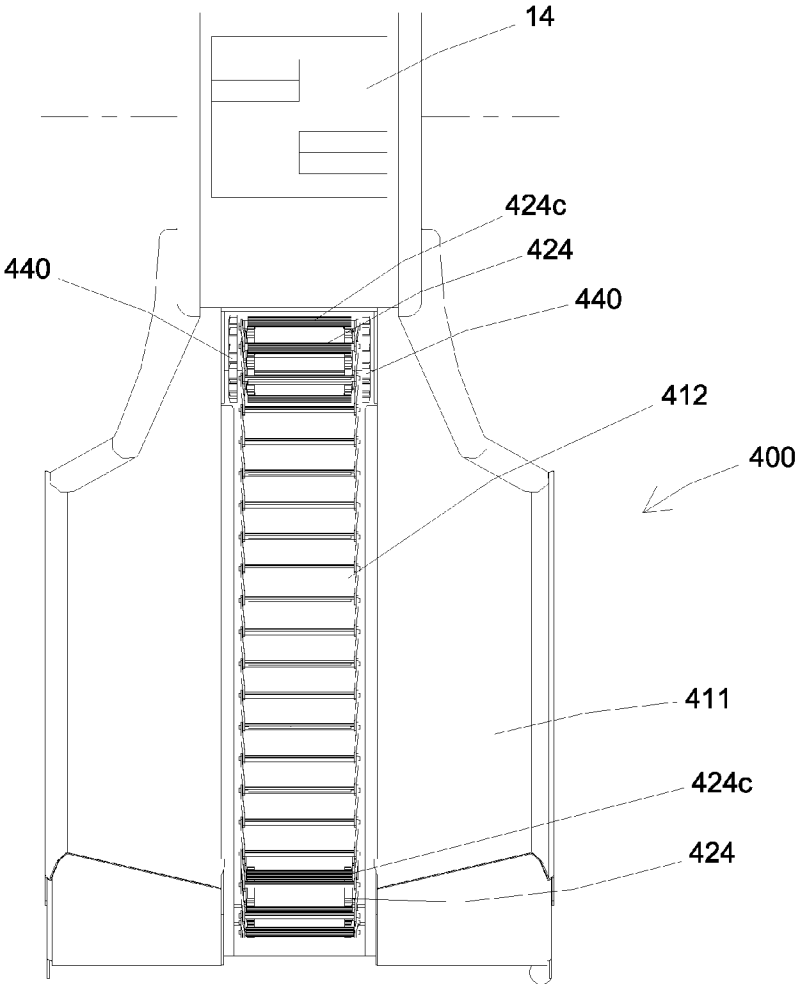
FIG. 16 is a top view of the FIG. 15 embodiment.

FIGS. 15 and 16 show an alternate embodiment 400 that is essentially like embodiment 200 in FIG. 13, except that the rear sprocket is the same as the front sprocket, one being driven and the other one being an idler sprocket. The alternate embodiment 400 has a front sprocket 424 that is like sprocket 24 of FIGS. 1-10, except that it is wider. Also, there are two auxiliary feed rollers 440 that are like auxiliary feed roller 40 of FIG. 5, but relatively narrower. So logs on the feed table 411 would be moved by the chain 412 towards the lugs 424*c* on roller 424 and those lugs 424*c*, in conjunction with the lugs on auxiliary feed rollers 440 will push the log towards the main feed roller and towards the cutter drum 14.

The above described embodiments are the preferred embodiments, but this invention is not limited thereto. It is, therefore, apparent that many modifications and variations of the present invention are possible in light of the above teachings. It is, therefore, to be understood that within the scope of the appended claims, the invention may be practiced otherwise than as specifically described.

The invention claimed is:

1. A machine for processing at least one of logs and whole trees comprising:

a frame;

a material reducing drum operatively attached to the frame;

a feed table operatively attached to the frame for receiving and supporting trees and logs thereon, the feed table having a top, a bottom, a material entrance end and a material exit end;

a pair of mostly vertical walls on each side of the feed table, the walls being configured for funneling at least one of the logs and trees from the feed table to the material reducing drum;

a feed roller rotatably disposed between the feed table and the material reducing drum;

at least one infeed conveyor chain, each infeed conveyor chain defining a corresponding pair of chain sides and a plurality of bars extending between the corresponding pair of chain sides, the corresponding pair of chain sides and the plurality of bars extending therebetween together defining a plurality of chain openings within a given infeed conveyor chain;

at least one first sprocket, each first sprocket including a pair of first-sprocket disc portions each operatively rotatably attached to the frame along a first substantially horizontal axis located below the top of the feed table and closer to the material exit end than to the material entrance end of the feed table, each infeed conveyor chain passing around and being in operative contact with a given first sprocket, each first-sprocket disc portion further having a plurality of chain engaging depressions, each chain engaging depressing being disposed in and extending radially into a corresponding first sprocket disc portion, the chain engaging depressions being configured for engaging any given bar associated with a corresponding infeed conveyor chain during operation thereof, the pair of first-sprocket disc portions associated with a given first sprocket together carrying at least one lug, each given lug having a pair of lug ends, each respective lug end being carried on a corresponding first-sprocket disc portion, each lug end being located between a pair of chain engaging depressions associated with the corresponding first-sprocket disc portion, each lug being configured to extend up through any corresponding chain opening during operation of the corresponding infeed conveyor chain, each lug thereby being configured for engaging at least at times material on the feed table and thereby moving the material towards the material exit end of the feed table; and at least one second sprocket operatively rotatably attached to the frame along a second substantially horizontal axis located lower than the top of the feed table, each infeed conveyor chain further passing around and being in operative contact with a given second sprocket, each infeed conveyor chain thereby being in operative contact with a given pair of corresponding first and second sprockets for selectively moving the logs and trees along the infeed table towards the material reducing drum when the first and second sprockets rotate.

2. The machine according to claim 1, wherein a given first sprocket is configured for carrying both the at least one lug and a corresponding infeed conveyor chain.

3. The machine according to claim 1, wherein the pair of first-sprocket disc portions associated with a given first sprocket are comprised of a distinct pair of first-sprocket discs.

4. The machine according to claim 1, further comprising an additional first sprocket, an additional second sprocket, and an additional infeed conveyor chain, the first additional first sprocket and the additional second sprocket together operatively driving the additional infeed conveyor chain, the set of the additional first sprocket, the additional second sprocket, and the additional infeed conveyor chain and the set of the other first sprocket, the other second sprocket, and the other infeed conveyor chain being spaced from one another.

5. The machine according to claim 4, further comprising an auxiliary feed member located between the additional first sprocket and the other first sprocket, the auxiliary feed member defining at least one auxiliary lug.

6. The machine according to claim 1, wherein each lug is affixed directly to a corresponding pair of said first-sprocket disc portions.

7. The machine according to claim 1, wherein each first sprocket has an outer periphery, a given lug being disposed so as to extend radially outwardly beyond a respective outer periphery of the corresponding first sprocket.

8. The machine according to claim 1, wherein each respective lug end is rigidly carried by a corresponding first-sprocket disc portion.

9. The machine according to claim 1, wherein a given lug extends between and is carried by both of a corresponding pair of the first-sprocket disc portions.

10. The machine according to claim 1, wherein a given lug extends a first distance radially outwardly from a center of rotation of the first sprocket the first distance being farther than a second distance that the corresponding plurality of chain bars of the chain conveyor on the first sprocket extend from the center of rotation of the first sprocket.

11. A machine for processing at least one of logs and whole trees comprising:

a frame;

a material reducing drum operatively attached to the frame;

a feed table operatively attached to the frame for receiving and supporting trees and logs thereon, the feed table having a top, a bottom, a material entrance end and a material exit end;

a pair of mostly vertical walls on each side of the feed table, the walls being configured for funneling at least one of the logs and trees from the feed table to the material reducing drum;

a feed roller rotatably disposed between the feed table and the material reducing drum;

at least one infeed conveyor chain, each infeed conveyor chain defining a corresponding pair of chain sides and a plurality of bars extending between the corresponding pair of chain sides, the corresponding pair of chain sides and the plurality of bars extending therebetween together defining a plurality of chain openings within a given infeed conveyor chain;

at least one first sprocket, each first sprocket including a pair of first-sprocket disc portions each operatively rotatably attached to the frame along a first substantially horizontal axis located below the top of the feed table and closer to the material exit end than to the material entrance end of the feed table, each infeed conveyor chain passing around and being in operative contact with a given first sprocket, each first-sprocket disc portion further having a plurality of chain engaging depressions, each chain engaging depression being disposed in and extending radially into a corresponding first sprocket disc portion, the chain engaging depressions being configured for engaging any given bar associated with a corresponding infeed conveyor chain during operation thereof, the pair of first-sprocket disc portions associated with a given first sprocket together carrying at least one lug, each given lug having a pair of lug ends, each respective lug end being carried on and extending radially away from a corresponding first-sprocket disc portion, each lug end being distinct from any chain engaging depression and being located between a corresponding pair of chain engaging depressions associated with the corresponding first-sprocket disc portion, each lug being configured to extend up through any corresponding chain opening during operation of the corresponding infeed conveyor chain, each lug thereby being configured for engaging at least at times material on the feed table and thereby moving the material towards the material exit end of the feed table; and at least one second sprocket operatively rotatably attached to the frame along a second substantially horizontal axis located lower than the top of the feed table, each infeed conveyor chain further passing around and being in operative contact with a given second sprocket, each infeed conveyor chain thereby being in operative contact with a given pair of corresponding first and second sprockets for selectively moving the logs and trees along the infeed table towards the material reducing drum when the first and second sprockets rotate.

12. The machine according to claim 11, wherein each lug is affixed directly to a corresponding pair of said first-sprocket disc portions.

13. The machine according to claim 11, wherein each first sprocket has an outer periphery, a given lug being disposed so as to extend radially outwardly beyond a respective outer periphery of the corresponding first sprocket.

14. The machine according to claim 1, wherein a given lug end is spaced from each chain engaging depression between which the given lug end is located.

15. A machine for processing at least one of logs and whole trees comprising:

a frame;

a material reducing drum operatively attached to the frame;

a feed table operatively attached to the frame for receiving and supporting trees and logs thereon, the feed table having a top, a bottom, a material entrance end and a material exit end;

a feed roller rotatably disposed between the feed table and the material reducing drum;

at least one infeed conveyor chain, each infeed conveyor chain defining a corresponding pair of chain sides and a plurality of bars extending between the corresponding pair of chain sides, the corresponding pair of chain sides and the plurality of bars extending therebetween together defining a plurality of chain openings within a given infeed conveyor chain; and at least one first sprocket, each first sprocket including a pair of first-sprocket disc portions each operatively rotatably attached to the frame along a first substantially horizontal axis located below the top of the feed table and closer to the material exit end than to the material entrance end of the feed table, each infeed conveyor chain passing around and being in operative contact with a given first sprocket, each first-sprocket disc portion further having a plurality of chain engaging depressions, each chain engaging depression being disposed in and extending radially into a corresponding first sprocket disc portion, the chain engaging depressions being configured for engaging any given bar associated with a corresponding infeed conveyor chain during operation thereof, the pair of first-sprocket disc portions associated with a given first sprocket together carrying at least one lug, each given lug being distinct from the corresponding pair of first-sprocket disc portions, each given lug defining a pair of lug ends, each respective lug end being carried on a corresponding first-sprocket disc portion, each lug end being located between a corresponding pair of chain engaging depressions associated with the corresponding first-sprocket disc portion, each lug being configured to extend radially outwardly through a given chain opening, each lug thereby being configured for engaging and moving at least at times material on the feed table; and at least one second sprocket operatively rotatably attached to the frame along a second substantially horizontal axis located lower than the top of the feed table, each infeed conveyor chain further passing around and being in operative contact with a given second sprocket.

16. The machine of claim 15, wherein each given chain depression is defined solely within a corresponding first-sprocket disc portion.

17. The machine according to claim 15, wherein a given lug end is spaced from each chain engaging depression between which the given lug end is located.

* * * * *